US009359179B2

(12) United States Patent
Krug

(10) Patent No.: US 9,359,179 B2
(45) **Date of Patent: *Jun. 7, 2016**

(54) METHODS AND APPARATUSES FOR A SMALL VEHICLE JACK APPARATUS

(71) Applicant: MoJack Distributors, LLC, Wichita, KS (US)

(72) Inventor: Norman J. Krug, Arkansas City, KS (US)

(73) Assignee: Mojack Distributors, LLC, Wichita, KS (US)

( * ) Notice: Subject to any disclaimer, the term of this patent is extended or adjusted under 35 U.S.C. 154(b) by 508 days.

This patent is subject to a terminal disclaimer.

(21) Appl. No.: 13/902,942

(22) Filed: May 27, 2013

(65) Prior Publication Data

US 2013/0256614 A1 Oct. 3, 2013

Related U.S. Application Data

(63) Continuation of application No. 13/480,311, filed on May 24, 2012, now Pat. No. 8,448,920, which is a continuation of application No. 12/252,992, filed on Oct. 16, 2008, now abandoned, which is a continuation (Continued)

(51) Int. Cl.

| | |
|---|---|
| ***B66F 7/26*** | (2006.01) |
| ***B66F 5/02*** | (2006.01) |
| *B66F 7/28* | (2006.01) |

(52) U.S. Cl.

CPC ... *B66F 7/26* (2013.01); *B66F 5/02* (2013.01); *B66F 7/28* (2013.01); *Y10T 29/49826* (2015.01)

(58) Field of Classification Search

CPC ..... B66F 7/04; B66F 7/08; B66F 7/16; B66F 5/02

See application file for complete search history.

(56) References Cited

U.S. PATENT DOCUMENTS

| | | | |
|---|---|---|---|
| 652,836 | A | 7/1900 | Covert |
| 1,029,823 | A | 6/1912 | Richardson |
| 1,554,120 | A | 9/1925 | Mosher |
| 1,920,350 | A | 8/1933 | Bourdon |
| 2,551,483 | A | 5/1951 | Bartoe |

(Continued)

FOREIGN PATENT DOCUMENTS

| | | |
|---|---|---|
| CH | 526 463 | 8/1972 |
| CH | 526 463 A | 8/1972 |

(Continued)

OTHER PUBLICATIONS

International Search report of corres PCT/US2010/024902 dated Jun. 9, 2010.

(Continued)

*Primary Examiner* — Lee D Wilson

(74) *Attorney, Agent, or Firm* — Spencer Fane LLP

(57) ABSTRACT

An apparatus with a wheel engagement mechanism for operation with a jack assembly for engaging and elevating two wheels of a multi-wheeled vehicle relative to the ground is provided. The apparatus includes a base, a support member connected to the base, and a wheel support assembly. The wheel support assembly includes wheel supports connected at the ends of the wheel support assembly that extend outward from the wheel support assembly for supporting two wheels of the vehicle. The apparatus also includes an actuation mechanism for selectively raising and selectively lowering the wheel support assembly to raise and lower the vehicle.

30 Claims, 6 Drawing Sheets

Related U.S. Application Data of application No. 11/327,264, filed on Jan. 7, 2006, now abandoned, which is a continuation-in-part of application No. 11/147,571, filed on Jun. 8, 2005, now Pat. No. 7,823,861.

(56) References Cited

U.S. PATENT DOCUMENTS

| | | | | |
|---|---|---|---|---|
| 2,640,615 | A | 6/1953 | Wedel | |
| 2,857,985 | A | 10/1958 | Simmons, Sr. | |
| 2,867,409 | A | 1/1959 | Southerwick | |
| 2,947,513 | A | 8/1960 | Nolden | |
| 2,991,811 | A | 7/1961 | Turner | |
| 2,992,811 | A | 7/1961 | Turner | |
| 3,038,700 | A | 6/1962 | Ascherl | |
| 3,215,402 | A | 11/1965 | Hott | |
| 3,225,868 | A | 12/1965 | Barnes | |
| 3,306,579 | A | 2/1967 | Campbell | |
| 3,378,154 | A | 4/1968 | Mousel | |
| 3,385,401 | A | 5/1968 | Campbell | |
| 3,844,421 | A | 10/1974 | Nielsen | |
| 3,924,763 | A | 12/1975 | Pigeon | |
| 4,030,697 | A | 6/1977 | Robinson | |
| 4,066,243 | A | 1/1978 | Johnson | |
| 4,123,038 | A | 10/1978 | Meyers | |
| 4,421,209 | A | 12/1983 | Vermette | |
| 4,473,237 | A | 9/1984 | Lind | |
| 4,549,721 | A | 10/1985 | Stone | |
| 4,564,207 | A | 1/1986 | Russ | |
| 4,632,627 | A | 12/1986 | Swallows | |
| 4,632,629 | A | 12/1986 | Kooima | |
| 4,645,181 | A | 2/1987 | Schapansky | |
| 4,674,943 | A | 6/1987 | Nespor | |
| 4,678,392 | A | 7/1987 | Capers | |
| 4,761,111 | A | 8/1988 | Brown | |
| 4,797,058 | A | 1/1989 | Bilas | |
| 4,836,737 | A | 6/1989 | Holmes | |
| 4,932,639 | A | 6/1990 | Fjellstrom | |
| 4,984,657 | A | 1/1991 | Burns | |
| 4,986,720 | A | 1/1991 | Holmes | |
| 5,000,423 | A | 3/1991 | Snickers | |
| 5,123,802 | A | 6/1992 | Bell | |
| 5,176,487 | A | 1/1993 | Flitton | |
| 5,249,777 | A | 10/1993 | Herving | |
| 5,326,216 | A | 7/1994 | Russ | |
| 5,352,083 | A | 10/1994 | Roberts | |
| 5,358,217 | A | 10/1994 | Dach | |
| 5,362,196 | A | 11/1994 | Beattie | |
| 5,366,338 | A | 11/1994 | Mortensen | |
| 5,632,475 | A | 5/1997 | McCanse | |
| 5,711,512 | A | 1/1998 | Kauffman | |
| 5,984,616 | A | 11/1999 | Youmans | |
| 5,988,974 | A | 11/1999 | Zackovich | |
| 6,330,997 | B2 | 12/2001 | McGlaun | |
| 6,390,450 | B1 | 5/2002 | Bressner | |
| 6,439,346 | B1 | 8/2002 | Gradziuk | |
| 6,474,626 | B1 | 11/2002 | Box | |
| D468,512 | S | 1/2003 | Hernandez | |
| 6,516,597 | B1 | 2/2003 | Samejima et al. | |
| 6,601,825 | B2 | 8/2003 | Bressner | |
| 6,692,218 | B2 | 2/2004 | Grile | |
| 6,712,380 | B1 | 3/2004 | Edens | |
| 6,769,668 | B2 | 8/2004 | Siglock | |
| 6,921,095 | B2 | 7/2005 | Middleby | |
| 6,966,540 | B2 | 11/2005 | Falk | |
| 7,111,444 | B1 | 9/2006 | Morris | |
| 7,448,839 | B2 | 11/2008 | Grile | |
| 7,503,577 | B2 | 3/2009 | McEvoy | |
| 7,740,439 | B1 | 6/2010 | Browning | |
| 7,798,760 | B2 | 9/2010 | Strassman | |
| 7,823,694 | B2 | 11/2010 | Motes | |
| 7,823,861 | B2 * | 11/2010 | Krug | B66F 7/02 254/133 R |
| 7,997,606 | B1 | 8/2011 | Sandelius | |
| 8,016,303 | B1 | 9/2011 | Ullman | |
| 8,141,850 | B2 | 3/2012 | Drake | |
| 8,251,349 | B2 | 8/2012 | Drake | |
| 8,337,135 | B2 | 12/2012 | Underwood | |
| 8,387,953 | B2 | 3/2013 | Drake | |
| 8,448,920 | B2 * | 5/2013 | Krug | B66F 7/26 254/2 B |
| 2004/0076501 | A1 | 4/2004 | McGill | |
| 2005/0253122 | A1 | 11/2005 | Jones | |
| 2006/0045710 | A1 | 3/2006 | Hiebert | |
| 2006/0151247 | A1 | 7/2006 | Raffler | |
| 2006/0278855 | A1 * | 12/2006 | Krug | B66F 7/02 254/4 B |
| 2006/0278856 | A1 | 12/2006 | Krug | |
| 2009/0134374 | A1 * | 5/2009 | Krug | B66F 7/26 254/4 B |
| 2010/0102284 | A1 * | 4/2010 | Drake | B66F 5/02 254/1 |
| 2010/0283016 | A1 | 11/2010 | Drake | |
| 2011/0253995 | A1 | 10/2011 | Kato | |
| 2012/0032124 | A1 | 2/2012 | Drake | |
| 2012/0112143 | A1 | 5/2012 | Gann | |
| 2012/0228569 | A1 * | 9/2012 | Krug | B66F 7/26 254/134 |
| 2013/0256614 | A1 * | 10/2013 | Krug | B66F 7/26 254/2 B |

FOREIGN PATENT DOCUMENTS

| | | | |
|---|---|---|---|
| FR | 2 781 779 | A1 | 2/2000 |
| FR | 2781779 | | 2/2000 |
| GB | 885 599 | A | 12/1961 |
| GB | 885599 | | 12/1961 |
| JP | 62 108396 | | 7/1987 |
| JP | 62 108396 | U | 7/1987 |
| JP | 63 021695 | | 2/1988 |
| JP | 63 021695 | U | 2/1988 |
| JP | 2005 145571 | | 6/2005 |
| JP | 2005 145571 | A | 6/2005 |
| WO | WO 96/26886 | A1 | 9/1996 |
| WO | WO 9626886 | | 9/1996 |
| WO | WO 99/11556 | A1 | 3/1999 |
| WO | WO 9911556 | | 3/1999 |
| WO | WO 2010/047897 | A1 | 4/2010 |
| WO | WO 2010047897 | | 4/2010 |

OTHER PUBLICATIONS

International Search Report of corres PCT/US2009/057092, dated Dec. 15, 2009.

Notice of Allowance mailed Nov. 28, 2011 in corres U.S. Appl. No. 12/477,563, filed Jun. 3, 2009.

Notice of Allowance Mailed Jun. 24, 2010 in U.S. Appl. No. 11/147,571, filed Jun. 8, 2005.

OA mailed Dec. 27, 2011 in U.S. Appl. No. 13/275,234, filed Oct. 17, 2011.

OA mailed Jun. 6, 2012 in U.S. Appl. No. 13/275,234, filed Oct. 17, 2011.

OA mailed Apr.8, 2008 in connection with related U.S. Appl. No. 11/327,264, filed Jan. 7, 2006 (abandoned).

OA mailed Feb. 8, 2008 in connection with related U.S. Appl. No. 11/327,264, filed Jan. 7, 2006 (abandoned).

OA mailed Jul. 18, 2008 in connection with related U.S. Appl. No. 11/327,264, filed Jan. 7, 2006 (abandoned).

OA mailed Jul. 12, 2011 in corres U.S. Appl. No. 12/477,563, filed Jun. 3, 2009.

OA mailed May 9, 2008 in No. U.S. Appl. No. 11/147,571, filed Jun. 8, 2005.

OA mailed Feb. 28, 2007 in connection with related U.S. Appl. No. 11/147,571, filed Jun. 8, 2005.

OA mailed Jul. 30, 2008 in U.S. Appl. No. 11/147,571, filed Jun. 8, 2005.

OA mailed Aug. 28, 2007 in U.S. Appl. No. 11/147,571, filed Jun. 8, 2005.

International Written Opinion dated May 16, 2011, PCT/US2011/024902, filed Feb. 22, 2010.

Written Opinion of corres PCT/US2010/024902 dated Jun. 9, 2010.

(56) References Cited

OTHER PUBLICATIONS

Written Opinion of corres PCT/US2009/057092, dated Dec. 15, 2009.
"Safety Standard for Portable Automotive Lifting Devices", The American Society of Mechanical Engineers, New York, NY, May 31, 2006, 78 pgs.
"Omega Motorcycle/ATV Lift, Model No. 49154", SFA Companies, Kansas City, MO, 2002, 8 pgs.
International Written Opinion dated May 16, 2011, PCT/US20101024902, Filed Feb. 22, 2010.
Notice of Allowance mailed Dec. 26, 2012 in U.S. Appl. No. 12/707,999, filed Feb. 18, 2010, 7 pgs.
Office Communication mailed Feb. 28, 2007 in connection with related U.S. Appl. No. 11/147,571, filed Jun. 8, 2005.
Office Communication mailed Aug. 28, 2007, in connection with related U.S. Appl. No. 11/147,571, filed Jun. 8, 2005.
Office Action mailed May 9, 2008 in connection with related U.S. Appl. No. 11/147,571, filed Jun. 8, 2005.
Office Communication mailed Jul. 30, 2008 in connection with related U.S. Appl. No. 11/147,571, filed Jun. 8, 2005.
Notice of Allowance mailed Jun. 24, 2010 in connection with related U.S. Appl. No. 11/147,571, filed Jun. 8, 2005.
International Search Report of corresponding international application PCT/US2009/057092, dated Dec. 15, 2009.
Written Opinion of corresponding international application PCT/US2009/057092, dated Dec. 15, 2009.
International Search Report of corresponding international application PCT/US2010/024902, dated Jun. 9, 2010.
Written Opinion of corresponding international application PCT/US2010/024902, dated Jun. 9, 2010.
Office Communication mailed Jul. 18, 2008 in connection with related U.S. Appl. No. 11/327,264, filed Jan. 7, 2006 (abandoned).
Office Action mailed Apr. 8, 2008 in connection with related U.S. Appl. No. 11/327,264, filed Jan. 7, 2006 (abandoned).
Office Action mailed Feb. 8, 2008 in connection with related U.S. Appl. No. 11/327,264, filed Jan. 7, 2006 (abandoned).
Office Action dated Oct. 26, 2012 in corresponding U.S. Appl. No. 13/480,311, filed May 24, 2012, now patent 8,448,920, issued May 28, 2013, 11 pgs.
International Written Opinion dated May 16, 2011, PCT/US2010/024902, filed Feb. 22, 2010.

* cited by examiner

METHODS AND APPARATUSES FOR A SMALL VEHICLE JACK APPARATUS

CROSS-REFERENCE TO RELATED APPLICATIONS

This application claims the benefit of and is a continuation of U.S. application Ser. No. 13/480,311, filed May 24, 2012, now U.S. Pat. No. 8,448,920, which application was a continuation of application Ser. No. 12/252,992, filed Oct. 16, 2008, which is a continuation of U.S. application Ser. No. 11/327,264, filed Jan. 7, 2006, now abandoned, which is a Continuation-in-Part of U.S. application Ser. No. 11/147,571, filed Jun. 8, 2005, now U.S. Pat. No. 7,823,861, the contents of which are hereby incorporated by reference.

BACKGROUND OF THE INVENTION

Numerous small vehicle jacks have been invented to deal with the necessity of raising vehicles smaller than typical automobiles, for purposes of performing repairs and other typical needs. Generally, the jacks have been specific as to what kind of vehicle they were adapted to.

Referring now to U.S. Pat. No. 4,066,243 (Johnson), a jack for the use with automobile bumpers is shown, in which a frame is provided as a support means for a vertical pipe, which has a sleeve, which moves upward and downward around said pipe. A typical floor jack provided the upward lifting force against the sleeve, where the floor jack was attached to the sleeve portion through a ring. This device required a secondary jack, and was limited to the lifting of a vehicle body parts which would comprise a bumper.

Referring now to U.S. Pat. No. 4,123,038 (Meyers), an apparatus is disclosed in which an elaborate load bearing frame is provided, where the apparatus operates using two separate hydraulic jacks. There is no realistic application of this type of device with a small tractor or riding lawn mower.

Portable jacks for small tractors are specifically exampled in U.S. Pat. No. 4,549,721 (Stone), in which a screw-scissors jack was operated to provide lifting force against a framework so as to push the framework upward. It would appear that one of the drawbacks of this invention was that the framework had a rectangular configuration, which would create a problem where a portion of the framework had to be moved under the tractor front wheels. This requirement would present a problem in a situation where the tractor was unable to move under its own power, requiring physical work to move the tractor over the framework assembly. Further, this device would not work properly at a location where the ground on which the tractor was situated was not properly leveled.

Referring now to U.S. Pat. No. 5,358,217 (Dach), the lifting apparatus is disclosed, in which a framework had a narrow front end, and avoided some of the problems inherent in the Stone patent referenced above. This system required a hydraulic cylinder to provide an upward pushing force to lift the item or vehicle. Extended arms had curved metal prongs that were referenced as lifting points. This jack was not intended for use with small tractor wheels, but rather was intended for axle assemblies.

Referring now to U.S. Pat. No. 6,330,997 (McGlaun et al.), a lifting apparatus for small vehicles is shown. The assembly uses pivoting action of its framework to first engage the wheels, and then lift the wheels by pivoting the framework so as to use a lever action to urge the wheels off of the ground.

Referring now to U.S. Pat. No. 6,474,626 (Box), a rack for securing a lawn mower to an elevated position is shown, in which a cage-like framework assembly is provided, and where a flexible webbing is used with a wheel crank to pull the entire lawn mower into an elevated position. This assembly is similar to an automobile rack, with the exception that the lifting framework is rectangular in nature, and supports all four wheels of a push mower on rack.

Further patents have disclosed jacking mechanisms with riding lawn mowers. U.S. Pat. No. 6,516,597 (Samejima et al.) discloses a lawn tractor which allows manipulation of its wheel supports into position so that they can be used to assist in raising up the front end of the lawn tractor.

Referring now to U.S. Pat. No. D 468,512 S (Hernandez), an all-terrain vehicle lift is disclosed, in which a hydraulic cylinder is used, to lift a metal framework that is disposed at the front end of the apparatus. The invention uses a rectangular frame, and a support means for the wheel is limited to a single tire, and not to two wheels, unless they are fairly close together.

SUMMARY OF THE INVENTION

From time to time, small tractors, riding lawnmowers, and other similar vehicles require maintenance requiring that one end of the vehicle be elevated. The use of hydraulic floor jacks do not always provide a single stable support structure, and jack stands are often the wrong size with regard to the elevation requirements for the small vehicles. In some situations, the angle of the vehicle necessary to accomplish the desired elevation of one end of the vehicle, makes the use of small jacks unwieldy, since small hydraulic system jacks only have a single contact point. As the contact point rotates by virtue of the elevation difference between the front and back end of the vehicle, the contact point with the hydraulic jack may become unstable. Further, the amount of elevation necessary will often exceed a hydraulic jack assembly's capability.

A complete apparatus is necessary, where the wheels of the vehicle may be used to elevate the entire end of a vehicle, rather than relying on the frame or other similar contact points available with typical hydraulic jacks for such a vehicle. A means to provide use of a jack with a stationary vehicle is desired, where the supporting structure can be moved into position on a vehicle, without requiring movement of the vehicle onto the jack means itself.

This invention comprises a small portable jack that is intended for use with small tractors, riding lawn mowers, four-wheel sport motorcycles, and other small vehicles. This small vehicle jack support system obviates the need for hydraulic systems, but instead uses a vertical jack bar with a winch system and flexible strap on top of the apparatus to provide the lifting force.

The jack itself has a base that defines a stable platform, also referred to as a support frame, that is intended to slide underneath the front end of the tractor or other vehicle. This jack may also be used on the back end of the tractor or other similar vehicle, but for purposes of discussion, the front end of the vehicle will be used as the example with the lifting method and apparatus for this invention.

The framework that contacts the ground is preferably a rectangular configuration, in which the main frame members comprise parallel side beams, a front cross member, and two rear cross members for additional strength. The rear cross members are typically parallel, and allow a mounting plate to be affixed thereto, using bolts, or any other typical attachment means, such as welding, clamping, or other means commonly known and understood in the art. A vertical frame bar is fixed to the mounting plate, and projects upward.

A lifting frame is provided, in which a center bar is connected at its front end perpendicularly to a cross bar member, where said cross bar member has a length that is equal to or greater than the width of the support frame from side to side. The crossbar and center bar define a T-shaped structure. The crossbar sits upon the support frame, with its ends resting on crossbar rest members, where the crossbar rest members define the widest portion of the support frame.

The center bar has a rigid guide member fixed to each side of the center bar rear end, where the guide members are slightly angled rearward from a 90 degree or perpendicular setting. Each guide member is spaced apart and parallel to each other, defining a gap that is at least as wide as the width of the center bar. The center bar preferably has a width greater than the vertical frame bar. As the guide members are parallel to each other, they allow the vertical frame bar to be positioned between them.

Once the lifting frame is positioned so that the vertical frame bar is situated between the angled guide members, a top roller is placed through its receiving apertures located on the terminating ends of the guide members, so that the vertical frame bar is restrained within the guide member gap area. A bottom roller is also positioned on the opposite side of the vertical frame bar, through the side guide members. The bottom roller, the parallel guide members and top roller function as a sleeve, which fits around the vertical frame bar, allowing the lifting frame to be moved upward and downward, with the gap between the guide members allowing some limited horizontal motion of the lifting frame. This allows for easy adjustment to the position of the lifting frame.

The vertical frame bar supports a winch means on its top end, with a flexible strap providing the pulling force necessary to lift the vehicle. In instances where the apparatus is desired to have height adjustment capability, a separate extension bar is provided, which allows the vertical bar, without any top structures attached, to be inserted into the extension bar.

The extension bar is provided, when greater height is desired, than can be obtained from a standard vertical frame bar. Also, the separate extension bar is provided for the simple need of disassembly and storage when so desired. Since both situations are generally desired, an extension bar is typically used with this apparatus.

The extension bar defines an inner cavity which allows the length of the vertical frame bar to be inserted completely into the extension bar. The extension bar preferably has a width similar to the center bar, with the gap defined between the guide members sufficient to allow said guide members to move freely over the extension bar.

The extension bar supports a platform which in turn supports a geared winch system that operates a flexible strap. The end of the flexible strap defines a hook, which is able to connect to a lifting ring located on the center bar, in proximity to the guide member attachment points with the center bar.

Removable wheel supports are provided, which are defined by a horizontal shaft, with a crossmember spacer which defines prongs on each end of the spacer, with the prongs defining a horizontal extension that is able to impact against the bottom side of a wheel. The prongs are spaced apart to define a gap, with the wheel able to rest between said gap. The wheel support assembly is attached to the crossbar by sliding the shaft into the inlet of said crossbar and securing the shaft and crossbar to each other.

Safety features also include axle guards, which comprise prongs that project upwards from the crossbar, and prevent the axle from slipping off of the crossbar when in use. These prongs are able to be removed when not needed, or able to be positioned as desired so that they are able to provide axle movement restriction as needed. The axle prongs may be fixed to a shaft sleeve, which allows the crossbar to be inserted through it, allowing the prong and shaft sleeve to move along the length of the crossbar, with the axle of the vehicle being lifted able to be secured as to movement against the axle prong.

Once the wheels of the vehicle are secured within the gap between the wheel support spacer prongs, the handle of the winch assembly is turned, causing the flexible strapped to move upward, thus exerting a lifting force against the lift ring. The lifting frame is raised vertically. The weight of the vehicle on the cross bar maintains the orientation of the lifting frame in a fairly horizontal position. The frame is unable to angle downward due to do the top and bottom roller. The strap is withdrawn until the lifting frame has raised the vehicle to the desired level. The winch is locked in position, using the braking systems commonly associated with such winch systems.

One advantage of having a separate extension bar is that the overall height capabilities of the jack can be varied, according to the length of the extension bar. Use of the strap denies the need for any type of hydraulic system, with the winch apparatus providing sufficient force to the strap, especially if the winch apparatus has a geared ratio with regard to the handle movement.

The jack assembly is portable, in the sense that the support frame defines wheel axles that are defined as outwardly protruding axles, that are positioned immediately above the rearmost ends of the side frame members of the support frame, and project outward laterally to the side above the support frame. Wheels are used, which have a radius that very closely equals the distance from the axle to the ground, when the main frame is on ground level. For maximum support and strength, the wheels do not contact the ground surface, when the jack is in use. However, if the front portion of the frame is elevated, rotating the frame about the axles, the frame is angled upward from the rear toward the front. As the frame is elevated at the front, the wheels remain stationary as to location, and as the frame pivots around the axles, not only the front portion of the frame is elevated off of the ground level, but the rearmost portion of the frame is also slightly elevated, allowing the supporting wheels to remain and the single contact points of the apparatus and the ground. The entire apparatus can be manipulated into position so that the center of gravity passes through the wheel axles, making the weight of the apparatus negligible, with regard to movement from one location to another. Once the apparatus is positioned with the center of gravity over the wheel axles, it can be easily rolled from one point to another by a single person.

DETAILED DESCRIPTION OF THE INVENTION

Figure 1:
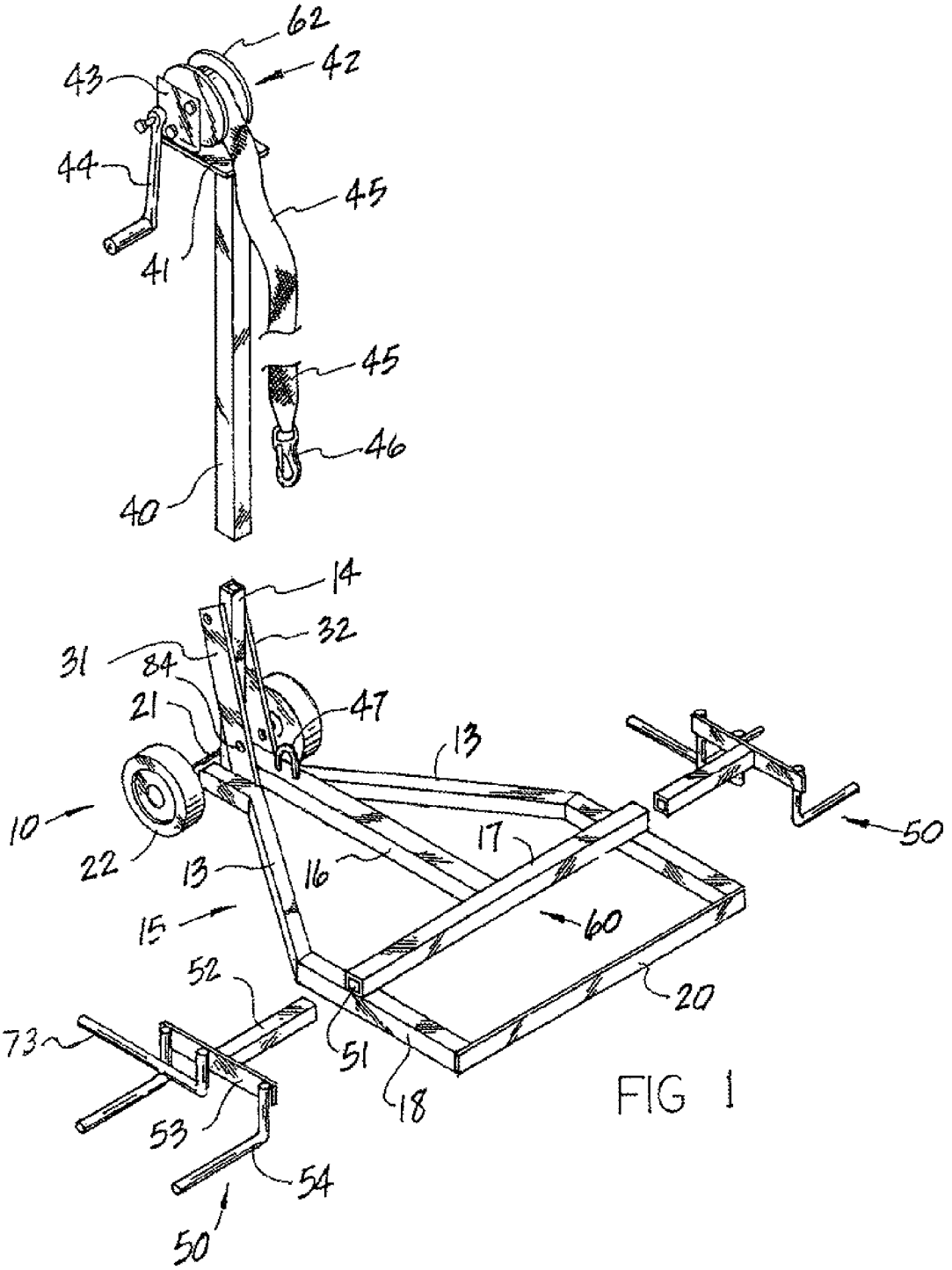
FIG. 1 is a perspective view of the improved small vehicle jack, in which the wheel support means and extension bar are shown in an exploded view.
Figure 7:
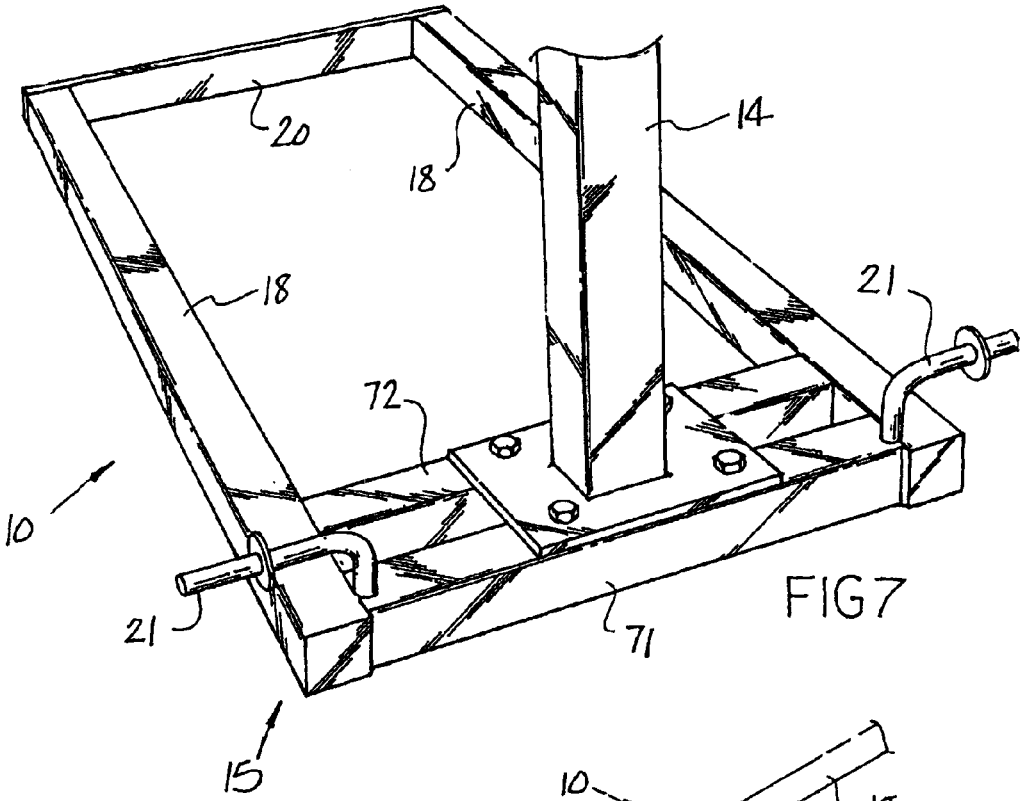
FIG. 7 is a perspective view from above and from the left rear portion of the improved small vehicle jack frame and vertical member, showing the wheel axles without the wheels mounted thereon.

Referring to FIG. 1, the improved small vehicle jack apparatus 10 is shown. Said apparatus 10 is comprised of a support frame 15, a lifting frame 60, a lifting means 42, and a wheel support means 50. The support frame 15 is comprised of two generally parallel crossbar rest members 18 and 19, which are spaced apart by a front member 20. A further improved configuration is shown also in FIG. 7, in which the support frame 15 is identical with regard to the front portion, where crossbar rest members 18 and 19 are separated by front member 20, but where the rear portion of the crossbar rest members 18 and 19 are not angled, but maintain a generally straight configuration. As FIG. 7 depicts, the support frame 15 may also be defined by cross bar rest members 18 and 19, which are spaced apart by front member 20, and also spaced apart by back support members 71 and 72, to form a rectangular configuration. In either configuration, members 18, 19 and 20, comprise the portion of the support frame 15 that is actually intended to be moved underneath the vehicle. Back support members 71 and 72 may comprise a single member, and should not be interpreted as being required as two separate members.

In the configuration shown in FIG. 1, the crossbar rest members 18 and 19 are attached to the front member 20 ends, with angled members 13 fixed to the crossbar rest member 18 and 19 rear ends. The angled side members 13 are angled in relation to each other so that the distance between them becomes closer toward each other along their length from the front toward the rear. The rear ends of the angled side members 13 define end portions 25 that are fixed in relation to each other and which allow a vertical frame bar 14 to be fixed in a vertical position at the rear portion of the apparatus 10.

Figure 2:
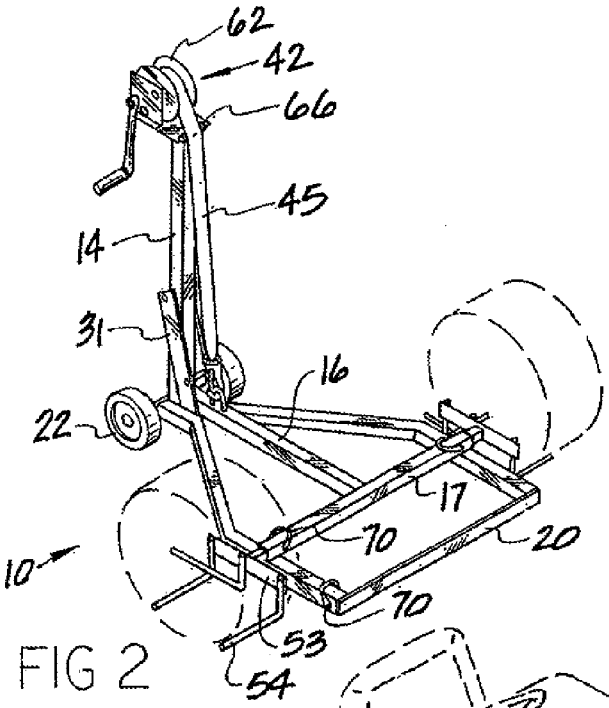
FIG. 2 is a perspective view of the improved small vehicle jack in which the vertical frame bar and comprises the vertical support for the winch system.
Figure 3:
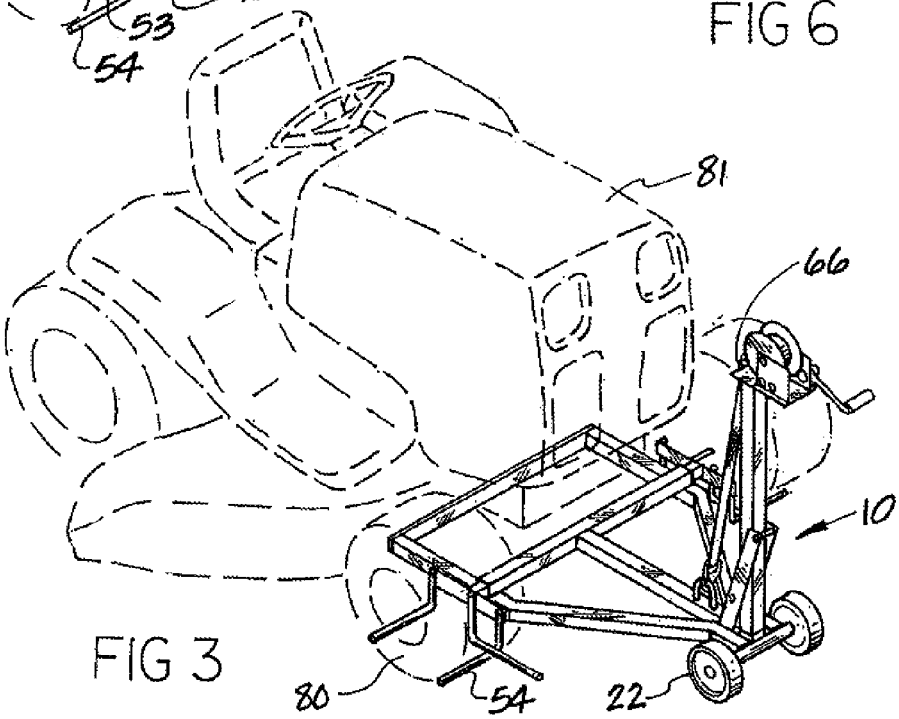
FIG. 3 is a perspective view from above a riding lawn mower with the improved small vehicle jack positioned underneath it, with the tires of the riding mower positioned above the wheel support means.
Figure 8:
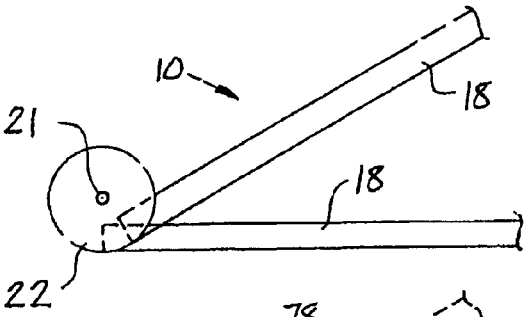
FIG. 8 is a side view showing the resting position of the frame and wheels, and the elevated position of the frame, in relation to the wheels.

As FIG. 7 shows, an axle 21 is provided, which is fixed to the rear end of this apparatus 10, and which supports wheels 22 located on either side of said support frame 15. The wheels 22 are fixed in such a manner that the rear portion of the support frame 15 is able to rest on the ground, with the wheels 22 providing ground contact for the rear portion of the support frame 15 if the apparatus 10 is tilted backwards. It should be understood however, that wheels 22 are not required, but are shown in FIGS. 2 and 3 as the preferred manner of construction, since wheels 22 provide for an ease of transportation, in which the support frame forward end is elevated, with the ground contact being borne solely by wheels 22. This allows ease of movement of the entire apparatus 10. Referring also to FIG. 8, the side frame member 18 is shown with the axle 21 and wheel 22 shown. When at rest, the support frame 15 will be in contact with the ground surface. As the front end of the side frame member 18 is elevated at the front, the support frame 15 pivots around the axle 21, and the entire support frame 15 pivots upward from the ground surface. The entire small vehicle jack 10 will be supported by the wheels 22, and if the entire jack 10 is pivoted so that the center of gravity is directly over the wheels 22, the effort to maintain the jack 10 off of the ground is minimized. Movement of the jack 10 is easily accomplished by allowing the wheels 22 to rotate around their axles 21.

Figure 12:
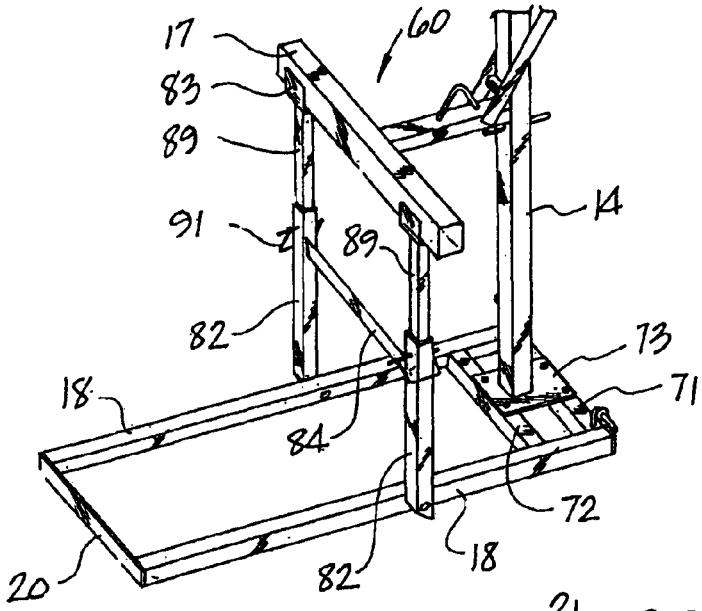
FIG. 12 is a perspective view of the jack showing the frame assembly, with the crossbar in a raised position, with the support guides and cups supporting the crossbar.
Figure 11:
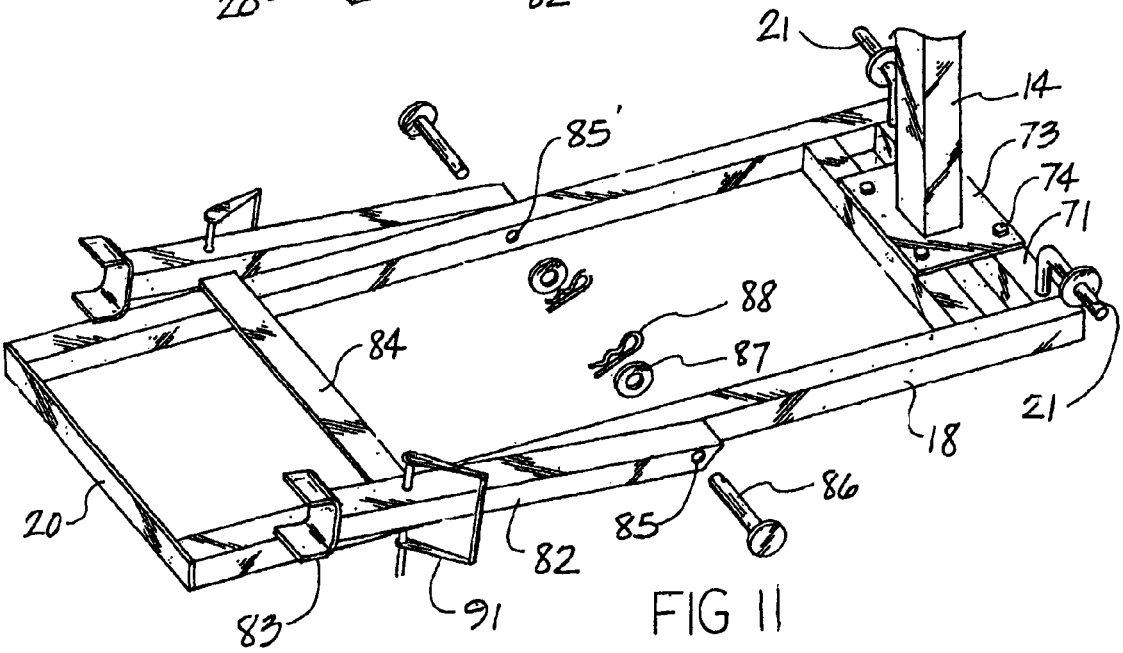
FIG. 11 is a perspective view of the jack showing the frame assembly and support guides in a lowered position.

In both the configurations shown in FIGS. 1, 2 and 3, and that shown in FIGS. 7, 11 and 12, the gap between the rear end portions 25 of the support frame 15 should be wide enough so as to accommodate the center bar 16 of the lifting frame 60, and any sleeve means utilized with said lifting frame 60. As the configuration in FIGS. 7, 11 and 12 show, there is no narrowing of the gap, since the side support members 18 and 19 remain parallel.

The fixed vertical frame bar 14 projects upward from the support frame 15. In the configuration shown in FIGS. 7, 11 and 12, the vertical frame bar 14 is fixed to the rear support members 71 and 72, which comprise the rearmost portion of the small vehicle jack apparatus 10. As these Figures show, the vertical frame bar 14 is fixed to a support plate 73, and where the support plate 73 is fixed to the rear support members 71 and 72, using bolts 74 which are placed through bolt holes 75 in the support plate 73 and also through bolt holes 76 in the rear support members 71 and 72. It should be understood that the vertical frame bar 14 may be fixed to the support plate 73 in any manner commonly known and understood in the art. Further, the support plate 73 is not required for this invention to operate, but rather the vertical frame bar 14 may be fixed to rear support members 71 and 72 individually or both, through any means commonly known and understood in the art. FIGS. 7, 11 and 12 show an alternative configuration for the rear portion of the jack 10, with regard to that shown in FIG. 1. In all other aspects, the operation of the jack 10 is equivalent in all Figures regarding the manner of raising the lifting frame 60.

As FIGS. 7, 11 and 12 show, the crossbar rest members 18 are generally parallel to one another, and are spaced apart by the front member 20 on the front or forward end, and spaced apart at the back by rear support members 71 and 72, to form a rectangular configuration. The rectangular configuration is but one of many possible configurations, and this invention should not be considered as being limited to a base having a rectangular configuration only.

FIGS. 11 and 12 further depict the means to support the lifting frame 60, while it is in a raised position. This means allows additional safety of this invention while in use, in that the means to support the lifting frame provides a stationary support that does not rely on the integrity of any lifting force, but rather provides support underneath the item being elevated.

Said means comprises support guides 82, which are defined as sleeves that pivot around a pivot bolt 86, where said bolt is placed though a guide hole 85, and also through frame hole 85', securing the support guide to the cross bar rest member 18. When not in use, the support guides 82 may be laid parallel to the crossbar rest member 18, or taken away by removing the bolt 86 so as to allow the crossbar rest member 18 to be moved independent of the apparatus 10.

The support guides 82 may comprise members that are adjustable as to length. Where said members are adjustable, the support guides 82 may comprise sleeves, which allow separate solid support guides 89 to be inserted into the sleeve support guides 82, and are adjustable as to overall length using an adjustment pin 91, which is inserted through the support guide 82 and one of several adjustment holes placed defined along the length of the solid support guide 89. The adjustment pin 91, when placed through the support guides 82 and solid support guides 89 will fix their position relative to each other, and also fix the combined overall length of the combination of both guides 82 and 89. The top or distal end of the solid support guide 89 defines a cup 83, which allows it to engage the underside of the item being lifted. Said cup 83 is fixed to the end of the solid support guide 89. If the adjustable features of this supporting system are not used, but rather the support guides 82 are used without the solid support guides 89, the cup 83 may be fixed to the top or distal end of the support guides 82, or said cup 83 may comprise a removal piece, and have a bottom leg extension that is able to be inserted into the support guide 82 in a manner similar to that shown by the solid support guides 83.

While FIG. 11 shows the support guides 82 in a down or rest position, FIG. 12 depicts the same guides 82 in a perpendicular configuration, with the solid support guides 89 shown extending out of the support guides 83, and supporting the cross bar 17 of the lifting frame 60. Since the support guides are secured to the crossbar resting members 18, and are vertical, they are able to assist in supporting the weight of the vehicle or contrivance being lifted by the apparatus 10, and provide a useful safety feature so that the lifting force is not wholly dependent solely on the strap 45 during the time that the frame 60 has lifted, and while waiting to be let back down.

FIG. 1 shows a separate extension bar 40, which fits down over the vertical frame bar 14. In one of the preferred embodiments, there is no separate extension bar 40, but the support frame 15 and incorporated vertical frame bar 14 support the winch means 42. As is shown in FIG. 2, the vertical frame bar 14 is fixed to the rear ends 25 of the support frame 15, and projects upward and supports a platform 41 and onto which a winch means 42 is provided. The winch means 42 is comprised of a spool, 62, a winch support 43 that fixes the position of the spool 62, and a handle 44, whose manipulation causes a geared assembly to cause the spool 62 to turn to take up or let out the length of the strap 45.

A flexible strap 45 is shown in FIG. 1 and in FIG. 2, where said strap 45 is wound about the spool 62, with its terminating end defining a hook 46. The flexible strap 45 is fed off of the spool 62, and a roller 66 is preferably provided at the edge of the platform 41 which supports the winch means 42. The flexible strap 45 is not limited to any type of specific material, but could include any type of flexible material that has durability and strength in its resistance to stretching and/or breakage. The term "strap" should be understood to include chains, cables, straps of various material, cords, in any other type of flexible straps may be used, and will all function in virtually the same manner.

As is shown in FIG. 2, the support frame 15 and incorporated vertical frame bar 14 comprise a general L-shaped configuration, where the total height of the apparatus 10 will always be consistent with the height of the vertical frame bar 14 and winch assembly 42.

FIG. 1 shows an embodiment of the apparatus 10 in which the vertical frame bar 14 has the same configuration, except that it is much shorter in FIG. 1 than it is in FIG. 2. In FIG. 1, an extension bar 40 operates as an extender of the vertical frame bar 14. The extension bar 40 may have any overall length desired by the operator of this apparatus 10. In this manner, the interchangeability of various extension bars 40 with a single support frame 15 and vertical frame 14, allows for a single support frame 15 to provide possibility for an apparatus 10 that has multiple choices of overall height as to the orientation of winch assembly 42. The winch assembly 42 as described for FIG. 2 operates in the same manner as the winch assembly 42 in FIG. 1. The winch assembly 42 may be detachable from the extension bar 40, so that a single winch assembly 42 and support frame 15 may be used with extension bars 40 of various lengths to create a jack apparatus 10 of varied overall heights.

The lifting frame is comprised of a center bar 16, which is attached at its front end to a crossbar 17, where said crossbar and center bar form a T-shaped structure. The crossbar 17 preferably has a length that is equal to or greater than the distance defined by the separation of crossbar rest members 18 and 19. The crossbar 17 is preferentially perpendicular to the crossbar rest members 18 and 19, with the terminating ends of the crossbar 17 able to sit on top of the respective crossbar rest members 18 and 19.

Wheel support means 50 are provided, which are shown as being detachable in FIG. 1 and in FIG. 2. It should be understood, that the detachability of the wheel support means 50 is considered to be an optional and a more advanced feature, than if the wheel support means 50 was permanently attached and made a part of the terminating ends of the crossbar 17.

As FIG. 1 shows, the wheel support means 50 is comprised of a main shaft 52, which supports a spacer 53, where said spacer 53 is oriented at 90 degrees from the shaft 52 to form a T-shaped configuration. Prongs 54 are attached at each end of the spacer 53, and project outward away from the apparatus 10, terminating at a free end. As FIG. 1 shows, the prongs 54 are defined and shown as L-shaped members, in which the horizontal portion of the prong 54 is lower than the spacer 53 and shaft 52. This is a preferred embodiment, since the horizontal portion of the prongs 54 are able to rest on the ground, while the crossbar 17 of the lifting frame 60 rests on top of the support frame 15.

The wheel support means 50 may be detachable from cross bar 17, in which the shaft 52 of the wheel support means 50 has an outer dimension that is at least less than the dimensions defined by insert 51, which comprises the opening into the interior of crossbar 17. Shaft 52 is moved into insert 51 until a desired position is reached, at which time both the shaft 52 and cross bar 17 are secured to each other using a securing pin 70, which is shown in use in FIG. 2. Such securing pins are common in the art.

Figure 5:
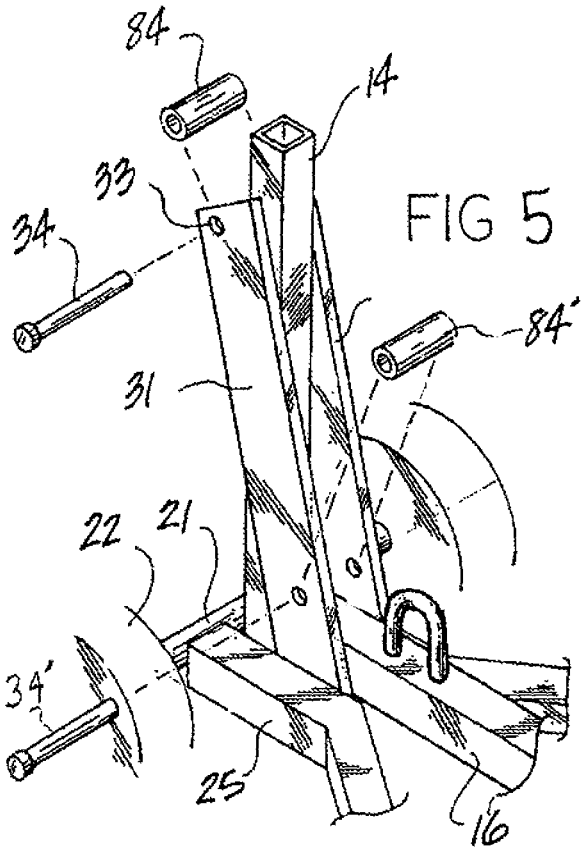
FIG. 5 is an enlarged view of the sleeve assembly, showing the guide members and the top and bottom roller.

The lifting frame 60, is fixed in position with regard to the vertical frame bar 14, or where an extension bar 40 is used, fixed in position to the extension bar 40 through a sleeve means. Referring now also to FIG. 5, a sleeve means comprises the rear end of center bar 16, in which guide members 31 and 32 are secured to the sides of the center bar 16, being secured at a slight rearward angle, as compared to a vertical position, so that the guide members 31 and 32 project both upwards, and slightly toward the rear.

Figure 6:
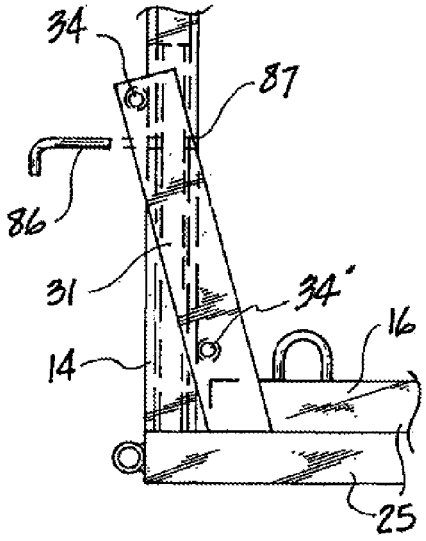
FIG. 6 is a side view of the sleeve means, in which the guide member is shown, with the lower and upper rollers shown, and where the safety pin is also shown.

The gap defined between the guide members 31 and 32 allow for placement of the vertical frame bar 14, or the extension bar 40 where one is used, with a top roller 84 placed through the respective holes 33 defined on the ends of guide members 31 and 32. Referring now also to FIG. 6, a bottom roller 84' is situated through the side guide members 31 and 32, in the manner that the top roller 84 is, with the bottom roller 84' positioned above the center bar 16, but adjacent to the vertical frame bar 14. The rollers 84 and 84' allow the lifting frame 60 to move smoothly upward and downward along the length of the vertical bar 14, or any extension bar 40, where one is used. The vertical frame bar 14, or the extension bar 40, when so situated between the guide members 31 and 32, will provide a guide that the lifting frame 60 can follow in a vertical manner.

Operation of the apparatus 10 is accomplished by attaching the hook 46, which is located on the end of the strap 45, to a lifting ring 47, which is located on the center bar 16. Lifting ring 47 is depicted as an inverted U-shaped member that is fixed to the top side of the center bar 16. It should be understood that any manner of connecting the strap 45 to the center bar 16 is understood to be contained within this embodiment. The strap 45 may be tied, or use any other connector means commonly known and understand in the art.

Where the wheel support means 50 are not detachable, the apparatus 10 must be positioned and the small vehicle 81 moved over the lifting frame crossbar 17 until the wheels 80 of the vehicle are placed in between the wheel support prongs 54. Referring now also to FIG. 3, once the wheels 80 are in position, apparatus may be actuated so as to raise the vehicle 81.

One clear advantage of wheel support means 50 being detachable, is that their relative position to the cross bar 17 can vary. This allows for a proper fit to a wide variety of mowers and small vehicle wheel bases, which may vary from vehicle to vehicle. By sliding the shaft 52 along the length of the insert 51 of cross bar 17, the wheel support means 50 can position the outer side of the spacer 53 against the wheel 80 of the vehicle 81. Since most small vehicles 81 are relatively light, the vehicle 81 is simply pushed or moved forward so that the wheels 80 are positioned between the prongs 54. The wheel support means 50 is then adjusted as to width, to ensure the proper fit.

This apparatus 10 is also useful where the vehicle is difficult to move. Referring back again to FIG. 1, that wheel supports 50 that are detachable, allow the wheels supports 50 to be independently placed around the wheels 80 of the vehicle 81. Once the wheel support means 50 are jointly position, with their shafts 52 oriented toward each other, the support frame 15 and lifting frame 17 are slid underneath the front end of the vehicle 81, until the crossbar 17 is positioned adjacent to the ends of the shafts 52 of each of the wheel support means 50.

Shafts 52 are able to be moved into insert 51 and may be secured using pins 70. This is a particularly advantageous operation, since small vehicles may not be movable under their own power, and the jack assembly 10 is able to be positioned so it can support the vehicle 81 without the vehicle 81 having to be moved at all.

Figure 4:
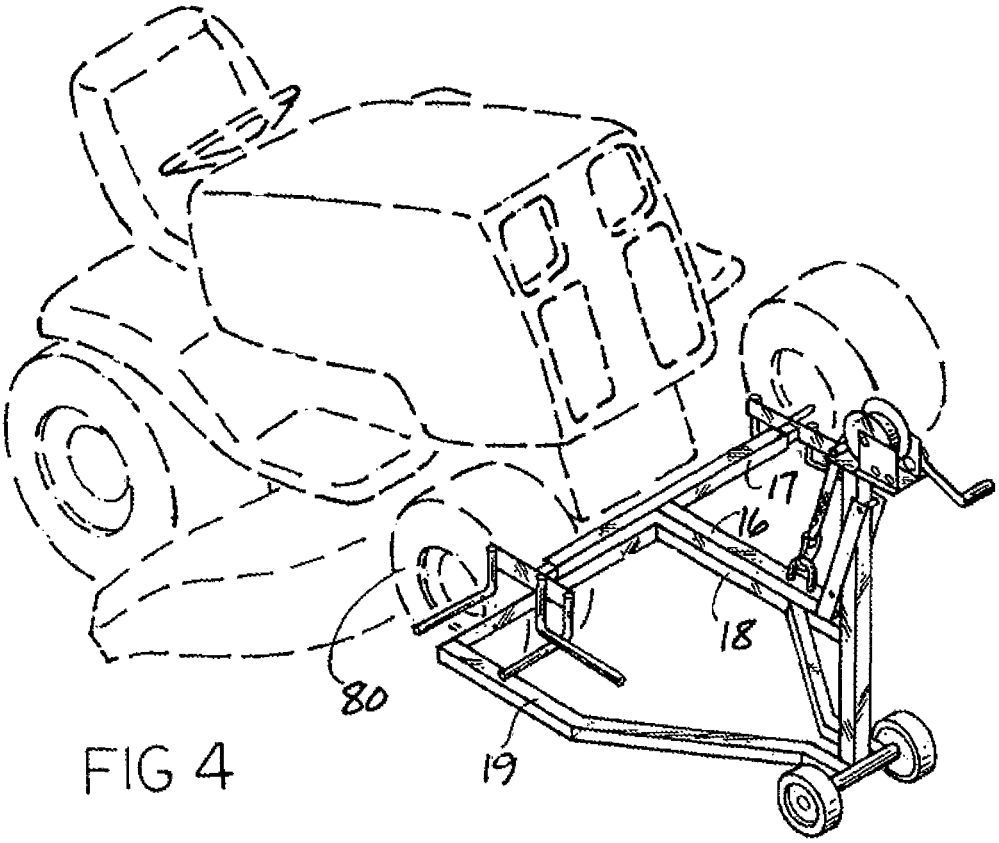
FIG. 4 is a perspective view of the riding mower and vehicle jack, where the jack assembly has been moved to a raised position with the front end of the riding mower shown elevated.

The lifting of the vehicle 81 is accomplished as shown in FIGS. 3 and 4. As FIG. 3 shows, the wheel support means are in the proper position, with the prongs 54 making ground contact. Other points of ground contact would likely comprise the front member 20 and wheels 22. Activation of the winch means 42, is accomplished by turning the handle 44 which causes the length of the strap 45 to be taken up by the spool 62. The strap 45 conveys a pulling force through the hook means 46 to the lifting ring 47 which causes the center bar 16 to move upward.

As the center bar 16, moves upward the weight of the vehicle 81 will be pressing downward on the wheel support means 50. Movement of the center bar 16 will be limited to vertical movement, as a result of the restrictions applied by the guide members 31 and 32 and top roller 84 and bottom roller 84'. Top roller 84 and bottom roller 84' will prevent the lifting frame 60 from tipping forward, as its forward movement will be prevented by the vertical frame bar 14, or the extension bar 40 if one is used. Removal of the apparatus 10 from the vehicle 81 involves a reverse process, where the vehicle 81 is lowered to the ground, the wheel support means 50 are slid out of the crossbar 17, and able to be removed from the vehicle area. The support frame 15 and lifting frame 60 are then pulled out from underneath the vehicle.

Figure 9:
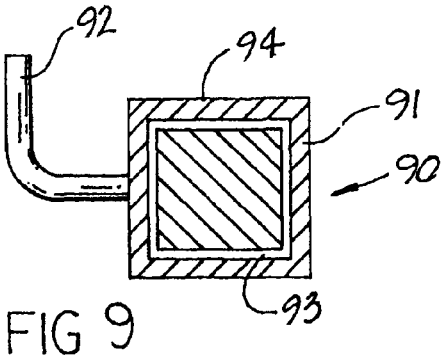
FIG. 9 is a cross sectional view of the crossbar and axle hook means.
Figure 10:
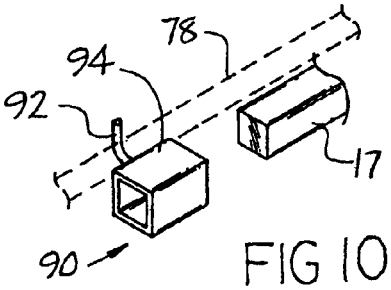
FIG. 10 is a perspective view of the crossbar and axle hook means, showing the relative position of an axle.

Referring now also to FIG. 9 and FIG. 10, an axle hook means 90 is shown, comprising an outer sleeve 91 which has an inner perimeter opening 93 that corresponds to the outer surface of the cross bar 17. The axle hook means 90 defines a top surface 94, with an upwardly projecting prong 92, with the axle hook means 90 able to slide along the length of the cross bar 17 until it is able to be positioned so as to allow the cross bar 17 to engage the axle 78 of a small vehicle. In this use, the wheel support means 50 may not be desired or used, and in the event that they are detachable, they can be removed during this process. The axle hook means 90 is placed over the end of the cross bar 17, so that the cross bar 17 is disposed through the opening 93. The projecting prong 92 preferably is fixed to the side of said outer sleeve 91, and is L-shaped, with a portion of its length extending upwards above the top surface 94, thus limiting the movement of any axle 78 past said prong 92. Said prong 92 may also function as the supporting contact point with the axle 78.

An additional safety feature is also shown FIG. 11 and FIG. 12, in which the From the foregoing statements, summary and description in accordance with the present invention, it is understood that the same are not limited thereto, but are susceptible to various changes and modifications as known to those skilled in the art and we therefore do not wish to be limited to the details shown and described herein, but intend to cover all such changes and modifications which would be encompassed by the scope of the appended claims.

The invention claimed is:

1. A wheel engagement assembly for elevating two wheels of a multi-wheeled vehicle above a support surface, comprising:

a base including a front portion, a rear portion, and opposite first and second sides;

a support member connected to the rear portion of the base; and a wheel support assembly connected to the support member, comprising:

a first wheel support and an adjacent second wheel support;

wherein the first wheel support supports a first wheel of the vehicle; and wherein the second wheel support supports a second wheel of the vehicle; and wherein the wheel support assembly is disposed over the front portion of the base.

2. The assembly of claim 1, wherein:

the first wheel support comprises:

a first front support extending outward away from the wheel support assembly for supporting the front of the first wheel; and a first rear support spaced apart from the first front support and extending outward away from the wheel support assembly for supporting the rear of the first wheel; and the second wheel support comprises:

a second front support extending outward away from the wheel support assembly for supporting the front of the second wheel; and a second rear support spaced apart from the second front support and extending outward away from the wheel support assembly for supporting the rear of the second wheel.

3. The assembly of claim 2, further comprising:
a first spacer disposed between the first front and rear supports connecting the first front and rear supports; and
a second spacer disposed between the second front and rear supports connecting the second front and rear supports.

4. The assembly of claim 3, wherein:
the wheel support assembly further comprises a crossbar extending between a first crossbar end and a second crossbar end;
the first spacer is connected to the first crossbar end; and
the second spacer is connected to the second crossbar end.

5. The assembly of claim 3, wherein:
the first front support is a prong projecting from the first spacer away from the second side;
the first rear support is a prong projecting from the first spacer away from the second side;
the second front support is a prong projecting from the second spacer away from the first side; and
the second rear support is a prong projecting from the second spacer away from the first side.

6. The assembly of claim 5, wherein:
the first front and rear supports are lower than the first spacer; and
the second front and rear supports are lower than the second spacer.

7. The assembly of claim 1, wherein:
the first wheel support is movable inward and outward from the assembly; and
the second wheel support is movable inward and outward from the assembly.

8. The assembly of claim 1, wherein the first wheel support and the second wheel support are detachable from the assembly.

9. The assembly of claim 1, wherein movement of the assembly about the support surface is unpowered.

10. The assembly of claim 1, wherein the base further comprises:
a first bar member at the first side;
a second bar member at the second side; and
a front member joining the first and second bar members.

11. The assembly of claim 10, further comprising a wheel assembly at the rear portion of the base.

12. The assembly of claim 1, further comprising an actuation mechanism for selectively raising and selectively lowering the wheel support assembly.

13. The assembly of claim 12, wherein the base is immobile as the wheel assembly is selectively raised and lowered.

14. The assembly of claim 1, further comprising a support guide extending between a first end pivotally connected to the base and a second end, the support guide supporting the wheel support assembly in an elevated position.

15. The assembly of claim 14, wherein the distance between the support guide first end and support guide second end is adjustable.

16. A wheel engagement assembly for elevating two wheels of a multi-wheeled vehicle above a support surface, comprising:
a base including a front portion, a rear portion;
a support member connected to the rear portion of the base; and
a wheel support assembly connected to the support member, comprising:
a first wheel support and an adjacent second wheel support;
wherein the first wheel support supports a first wheel of the vehicle; and
wherein the second wheel support supports a second wheel of the vehicle; and
wherein the base is disposed beneath the vehicle when the wheel support assembly is elevated.

17. The assembly of claim 16, wherein:
the first wheel support defies a first gap supporting the first wheel there between; and
the second wheel support defines a second gap supporting the second wheel there between.

18. The assembly of claim 16, wherein:
the first wheel support is movable inward and outward from the assembly for selectively positioning the first wheel support under the first wheel; and
the second wheel support is movable inward and outward from the assembly for selectively positioning the second wheel support under the second wheel.

19. The assembly of claim 16, further comprising an actuation mechanism for selectively raising and selectively lowering the wheel support assembly.

20. The assembly of claim 19, wherein the base is in contact with the support surface as the wheel assembly is selectively raised and lowered.

21. A wheel engagement assembly for elevating two wheels of a multi-wheeled vehicle above a support surface, comprising:
a base including a front portion, a rear portion, and opposite first and second sides;
a support member connected to the rear portion of the base; and
a wheel support assembly connected to the support member, comprising:
a first wheel support and an adjacent second wheel support;
wherein the first wheel support defines:
a first horizontal extension for supporting the bottom front of the first wheel; and
a second horizontal extension for supporting the bottom rear of the first wheel;
wherein the second wheel support defines:
a first horizontal extension for supporting the bottom front of the second wheel; and
a second horizontal extension for supporting the bottom rear of the second wheel.

22. The assembly of claim 21, wherein the base is disposed beneath the vehicle when the wheel support assembly is elevated.

23. The assembly of claim 21, wherein:
the first and second horizontal extensions of the first wheel support are connected by a first spacer; and
the first and second horizontal extensions of the second wheel support are connected by a second spacer.

24. The assembly of claim 23, wherein:
the first horizontal extensions are lower than the first spacer; and
the second horizontal extensions are lower than the second spacer.

25. The assembly of claim 23, further comprising an actuation mechanism for selectively raising and selectively lowering the wheel support assembly.

26. The assembly of claim 25, wherein the base is stationary to the support surface as the wheel assembly is selectively raised and lowered.

27. A wheel engagement assembly for elevating two wheels of a multi-wheeled vehicle above a support surface, comprising:
a base including a front portion, and a rear portion;
a support member connected to the rear portion of the base;

a wheel support assembly connected to the support member, comprising:

a first wheel support and an adjacent second wheel support;

wherein the first wheel support defines:

a first horizontal extension for supporting the bottom front of the first wheel; and a second horizontal extension for supporting the bottom rear of the first wheel;

wherein the second wheel support defines:

a first horizontal extension for supporting the bottom front of the second wheel; and a second horizontal extension for supporting the bottom rear of the second wheel;

an actuation mechanism for selectively raising and selectively lowering the wheel support assembly; and whereby the base is immobile as the wheel assembly is selectively raised and lowered.

28. The assembly of claim 27, wherein the base is stationary to the support surface as the wheel assembly is selectively raised and lowered.

29. The assembly of claim 27, wherein movement of the assembly about the support surface is unmotorized.

30. The assembly of claim 27, further comprising:

a wheel assembly at the rear of the base; and wherein pivoting the front of the base upward about the wheel assembly engages the wheel assembly with the support surface for moving the assembly about the support surface.

* * * * *